US006183268B1

(12) United States Patent
Consoli et al.

(10) Patent No.: US 6,183,268 B1
(45) **Date of Patent: *Feb. 6, 2001**

(54) HIGH-DENSITY ELECTRICAL CONNECTORS AND ELECTRICAL RECEPTACLE CONTACTS THEREFOR

(75) Inventors: John Joseph Consoli, Harrisburg; James Lee Fedder, Etters; Lynn Robert Sipe, Mifflintown, all of PA (US)

(73) Assignee: The Whitaker Corporation, Wilmington, DE (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/300,650

(22) Filed: Apr. 27, 1999

(51) Int. Cl.[7] ..... H01R 13/11; H01R 24/00
(52) U.S. Cl. ..... 439/74; 439/857
(58) Field of Search ..... 439/74, 75, 856, 439/857

(56) References Cited

U.S. PATENT DOCUMENTS

| | | | | |
|---|---|---|---|---|
| 3,693,139 | * | 9/1972 | Assmus et al. | 439/857 X |
| 3,867,008 | * | 2/1975 | Gartland, Jr. | 439/857 |
| 5,049,511 | * | 9/1991 | Yu | 439/856 X |
| 5,902,136 | * | 5/1999 | Lemke et al. | 439/74 |
| 5,903,059 | * | 5/1999 | Bertin et al | 439/74 X |
| 5,928,003 | * | 7/1999 | Kajinuma | 439/74 |

* cited by examiner

*Primary Examiner*—Stanley J. Witkowski

(57) ABSTRACT

An electrical connector for interconnecting circuit boards comprises a first electrical connector (12) and a second electrical connector (14), the first electrical connector including a first dielectric housing (16) in which an array of electrical blade contacts (34) is mounted, the second electrical connector including a second dielectric housing (42) in which an array of electrical receptacle contacts (58) is mounted, each of the receptacle contacts having hook-shaped fork members (60, 62) extending outwardly from a base member (64) and hook sections (**60*b*, 62*b*) bent away from each other defining a lead-in for a blade contact section (36) of a blade contact (34**) to be electrically connected therewith.

18 Claims, 5 Drawing Sheets

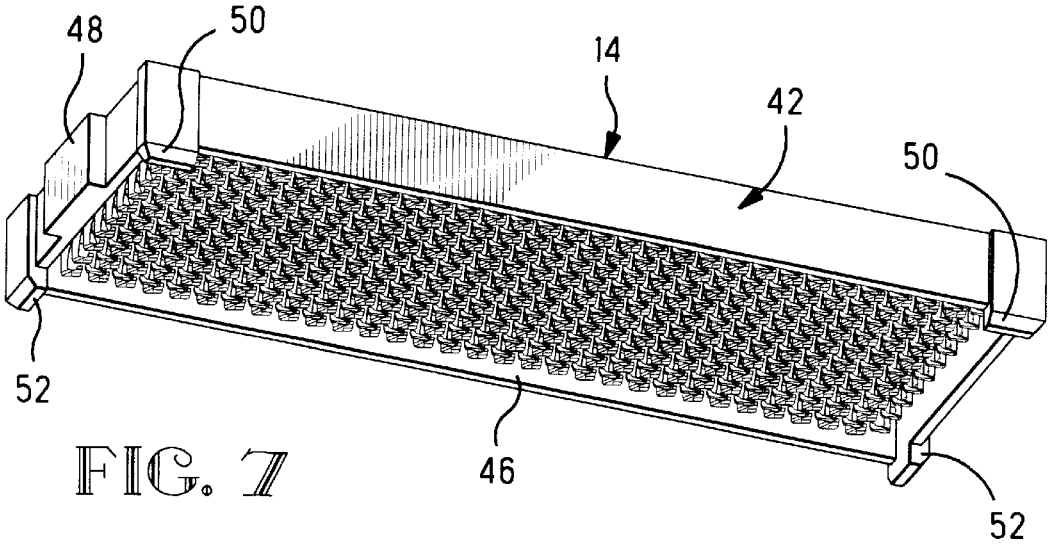
FIG. 7
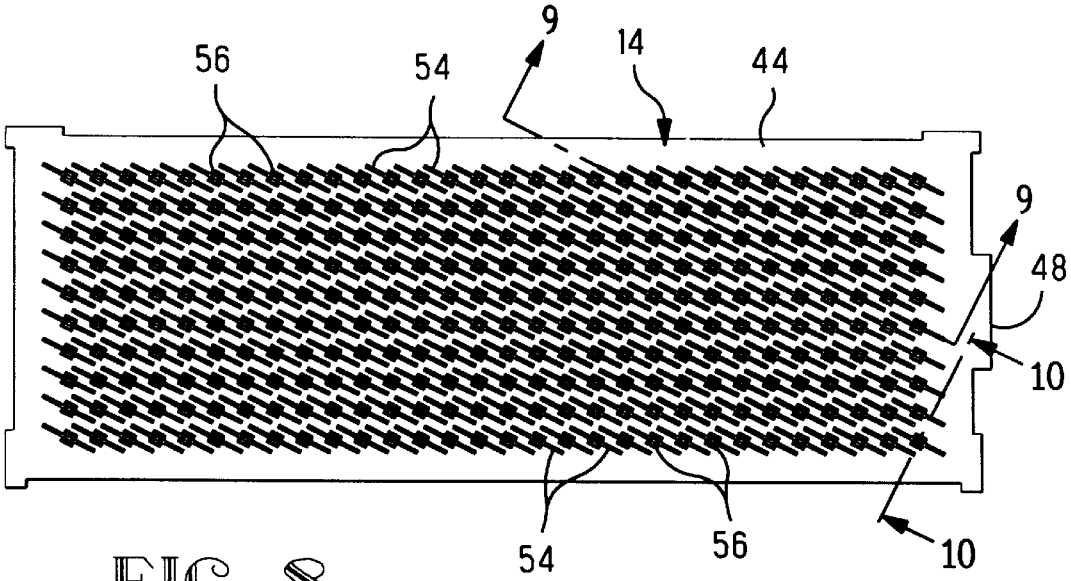
FIG. 8
FIG. 9
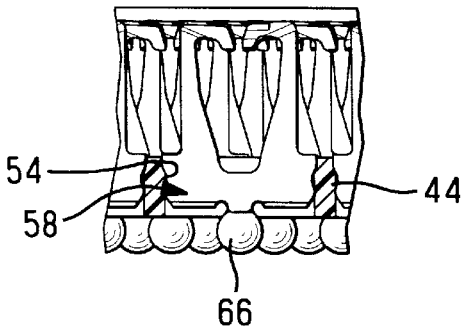

FIG. 10
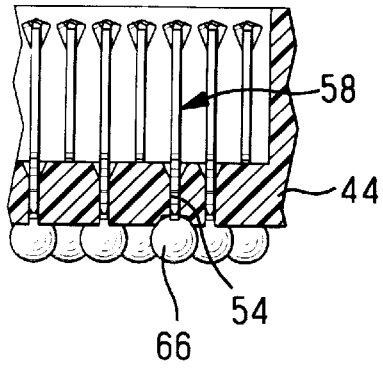
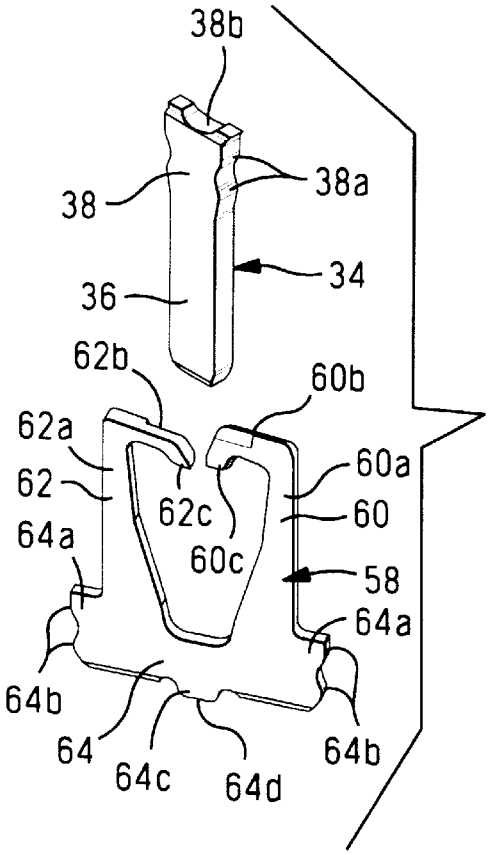
FIG. 11
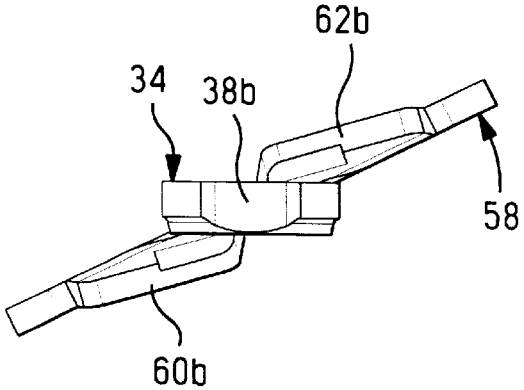
FIG. 12

HIGH-DENSITY ELECTRICAL CONNECTORS AND ELECTRICAL RECEPTACLE CONTACTS THEREFOR

FIELD OF THE INVENTION

The present invention relates to electrical connectors and more particularly to high-density electrical connectors and electrical receptacle contacts therefor.

BACKGROUND OF THE INVENTION

High-density electrical connectors for electrically connecting a processor board on which a microprocessor and memory devices are mounted to a mother board are known. The high-density electrical connectors include a plug housing matable with a receptacle housing, each of which is electrically connected to a processor board and a mother board. The plug housing has rows and columns of blade contacts and the receptacle housing has rows and columns of receptacle contacts having fork contact sections whereby the fork members thereof are located in a plane thereby operating as cantilever contact members reciprocally movable within the plane.

The blade contacts and receptacle contacts provide a large number of electrical interconnections therebetween in a very small area. The manufacturing of the contacts and the housings, the assembling of the contacts in their respective housings and the mating therebetween is very important regarding the manufacturing, assembling and mating tolerances. This is especially true with regard to the fork contact sections of the receptacle contacts. Moreover, the contact forces between the mating of the fork contact sections and the blade contact sections of the blade contacts is affected by virtue of the cantilever operation of the fork contact sections of the fork members. The tolerance problems of the fork contact sections and blade contact sections can result in less than acceptable electrical connections for optimum operation of the microprocessors and memory drives.

It is therefore very important to provide matable high-density electrical connectors that overcome the tolerance problems described above and that will effect optimum electrical connections between the electrical contacts thereof.

SUMMARY OF THE INVENTION

An electrical connector for interconnecting circuit boards comprises a first electrical connector and a second electrical connector; the first electrical connector including a first dielectric housing, an array of electrical blade contacts mounted in the first dielectric housing; the second electrical connector including a second dielectric housing; an array of electrical receptacle contacts mounted in the second dielectric housing at an angle relative to the blade contacts for electrical connection with the blade contacts, and each of the receptacle contacts having hook-shaped fork members extending outwardly from a base member and hook sections bent away from each other defining a lead-in for a blade contact section of a blade contact as well as a controlled gap at the mating tip to be electrically connected therewith.

BRIEF DESCRIPTION OF THE DRAWINGS

An embodiment of the present invention will now be described by way of example with reference to the accompanying drawings in which:

FIG. 7 is a perspective view of the second electrical connector.

FIG. 8 is a top plan view of the second electrical connector.

FIG. 9 is an enlarged cross-sectional view of a portion of FIG. 8.

FIG. 10 is an enlarged cross-sectional view looking from the right in FIG. 9.

FIG. 11 is an exploded perspective view showing a blade contact and a receptacle contact prior to being connected.

FIG. 12 is a top plan view of FIG. 11 showing the blade contact and the receptacle contact connected to each other.

DETAILED DESCRIPTION OF THE INVENTION

Figure 1:
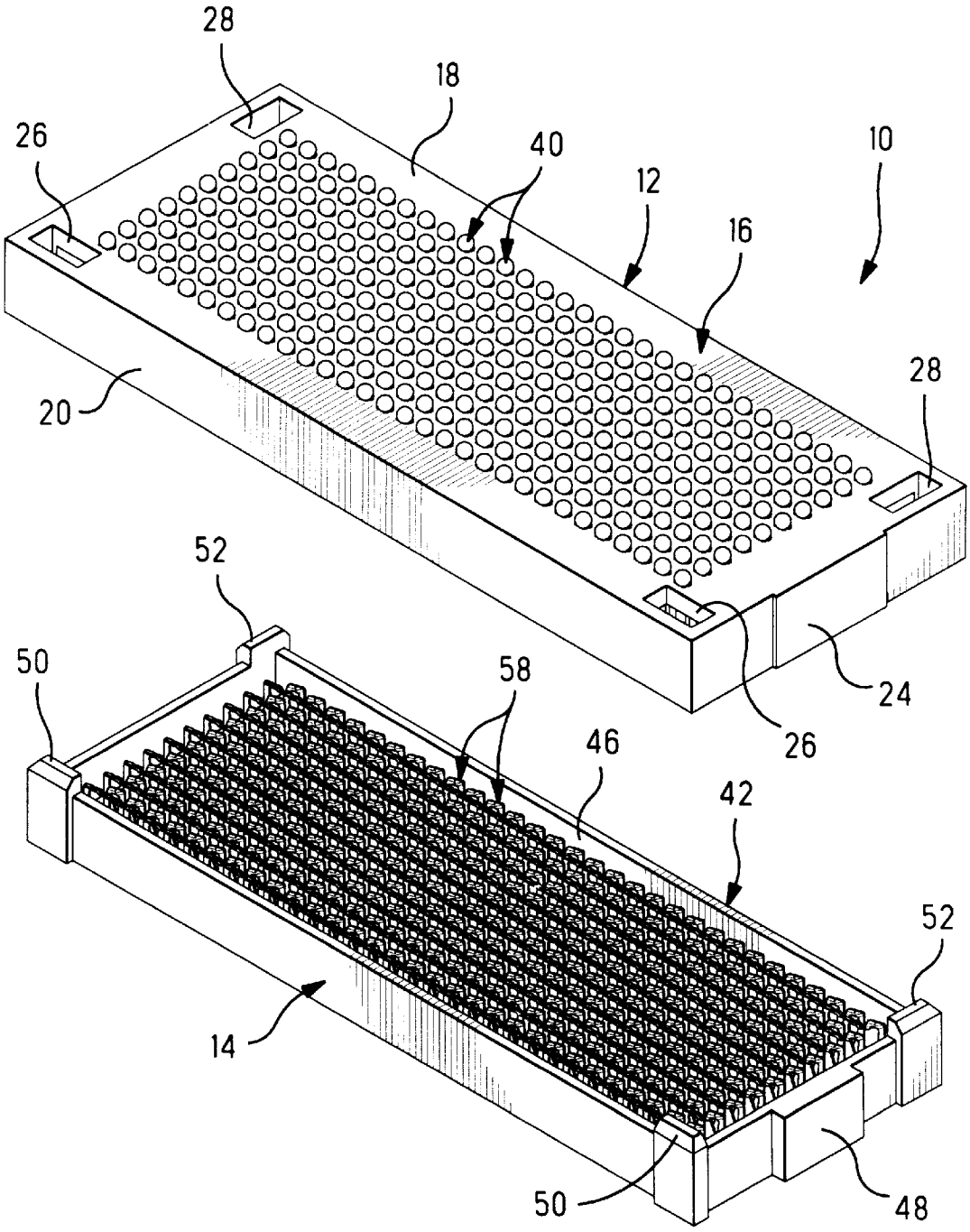
FIG. 1 is an exploded perspective view showing an electrical connector including a first electrical connector and a second electrical connector.
Figure 2:
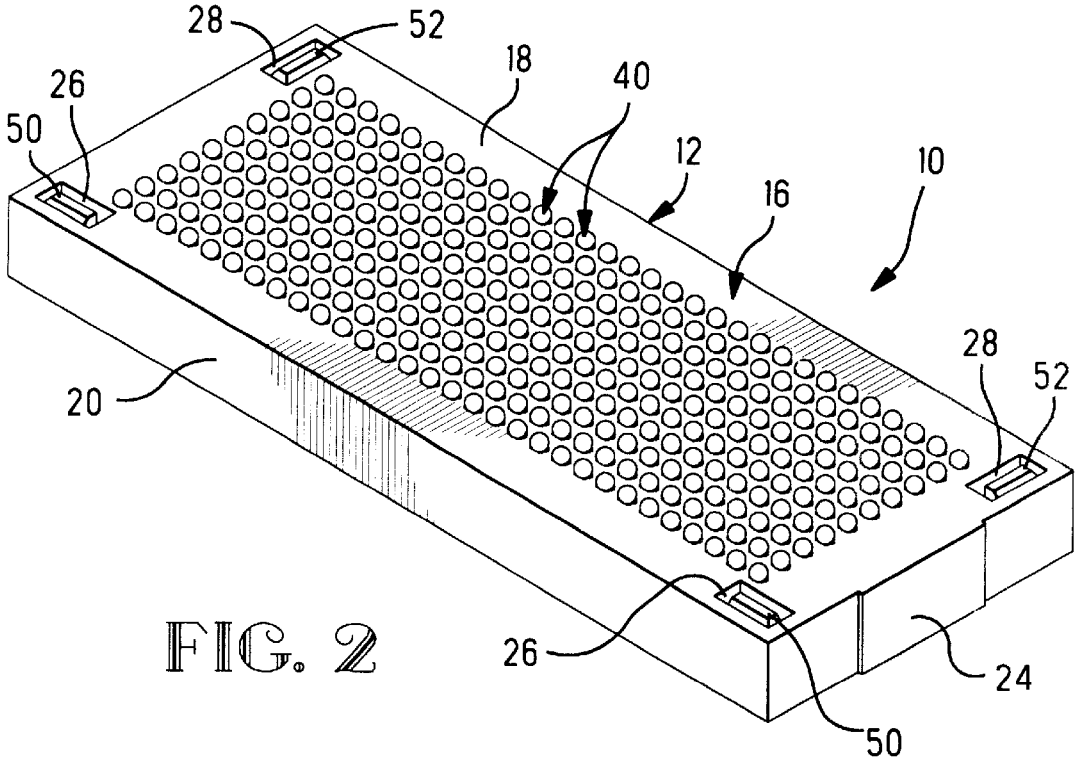
FIG. 2 is a perspective view showing the first and second electrical connectors mated together forming the electrical connector.

FIGS. 1 and 2 show an electrical connector 10 including a first electrical connector 12 and a second electrical connector 14. First electrical connector 12 is a plug connector as it receives second electrical connector 14, which is a receptacle connector. Either connector can be mounted on a mother circuit board or a processor circuit board; however, the plug connector is preferred to be mounted on the mother board.

Figure 3:
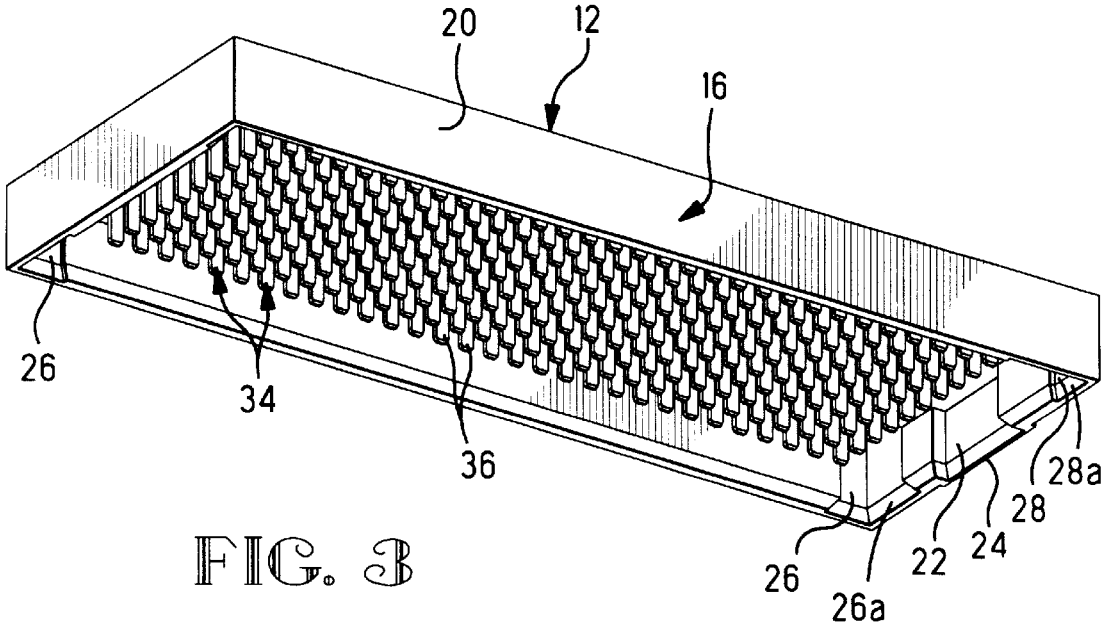
FIG. 3 is a perspective view showing the first electrical connector.
Figure 4:
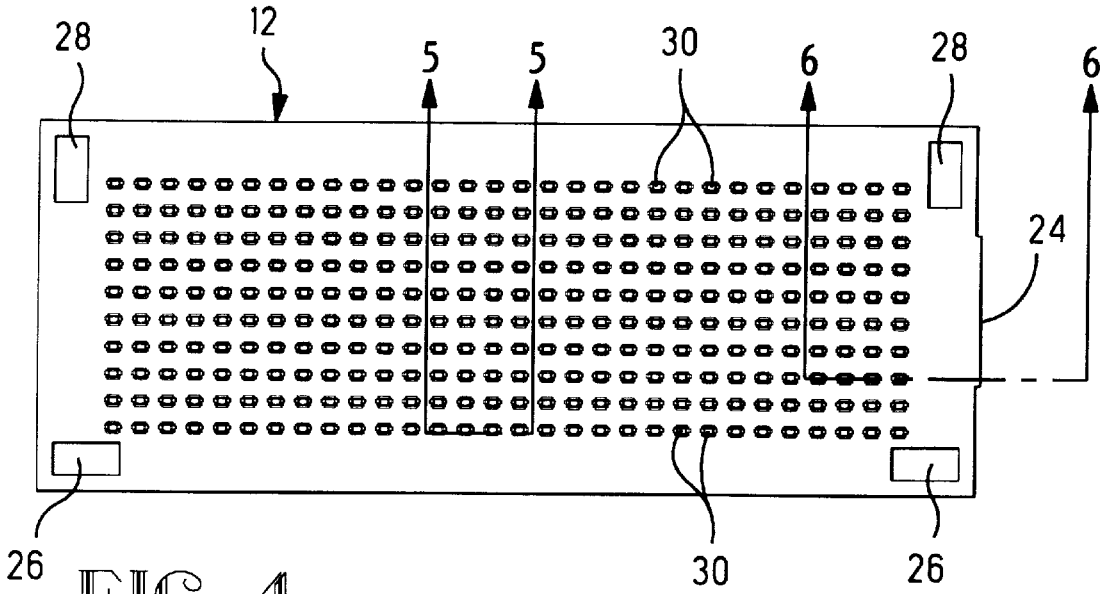
FIG. 4 is a top plan view of the first electrical connector.
Figure 5:
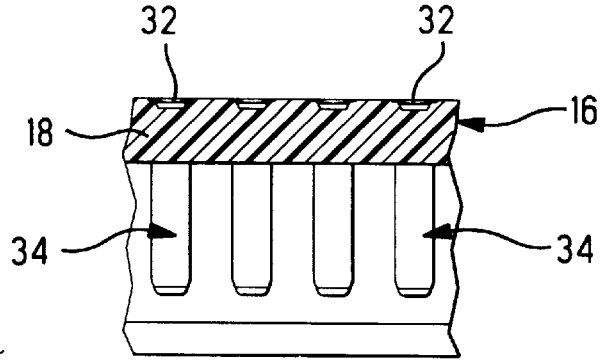
FIG. 5 is an enlarged cross-sectional view of a portion of FIG. 4.
Figure 6:
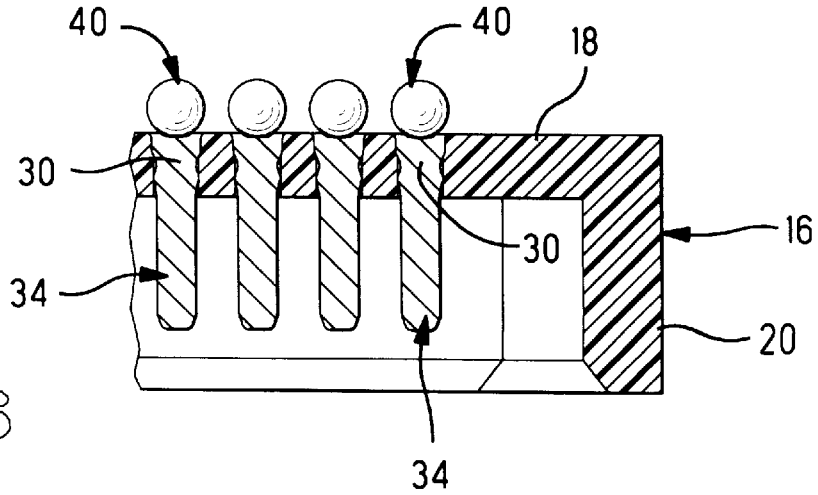
FIG. 6 is an enlarged cross-sectional view of another portion of FIG. 4.

First electrical connector 12 includes a dielectric first housing 16 of rectangular shape having a planar bottom wall 18 and a continuous shroud 20 extending outwardly from sides and ends of bottom wall 18. One end of shroud 20 includes an internal recess 22 within a projection 24. Rectangular slots 26 are located adjacent opposed ends of bottom wall 18 along one of the side walls of shroud 20, they extend through bottom wall 18. Rectangular slots 28 are located in bottom walls 18 along each end wall of shroud 20, they are disposed normal to slots 26 and they extend through bottom wall 18. The entrances to slots 26, 28, which are located at outer ends thereof, have tapered surfaces 26*a*, 28*a* (see FIG. 3). The same is true with internal recess 22. Also, the outer ends of the inner surfaces of shroud 20 are likewise tapered. Rows of slots 30 extend through bottom wall 18 forming horizontal rows and columns in first housing 16. Each of the slots 30 has a generally square recess 32 (FIG. 5) in an outer surface of the bottom wall 18 in communication therewith, the side surfaces of the square recesses 32 are tapered.

Blade contacts 34 are inserted into respective slots 30. As shown in FIG. 11, each blade contact 34 has a blade contact section 36 with a tapered front end and a securing section 38 with axially-spaced protuberances 38*a* that frictionally engage opposing walls of slots 30 thereby securing the blade contacts 34 in slots 30 in a stable manner with blade contact sections 36 being disposed within the confines of shroud 20 thereby protecting the blade contact sections. An arcuate depression 38*b* is located in an upper surface of securing section 38 of blade contact 34, and it along with a portion of an upper end of the securing section 38 is located in square recess 32. This arrangement permits solder balls 40 to be disposed in square recesses 32 and arcuate depressions 38*b* so as to be soldered thereto in accordance with conventional reflow solder practices. The recesses 32 serve to locate the solder balls 40 to accurate positions for circuit board mounting.

As can be discerned, blade contacts 34 form longitudinal rows and verticals columns in first housing 16 as a plug connector 12 which via solder balls 40 is soldered onto conductive pads of a mother or processor circuit board.

Second electrical connector 14 includes a dielectric second housing 42 of rectangular shape having a planar bottom wall 44 and a continuous shroud 46 extending outwardly from sides and ends of bottom wall 44. One end of shroud 46 has a projection 48. Rectangular projections 50 extend outwardly from the outer end of a side wall of shroud 46 as well as projections 52 that extend outwardly from the outer ends of the end walls of shroud 46. The outer ends of projections 50, 52 are tapered. Rows of slots 54 extend through the bottom wall 44 and they are in communication with square recesses 56 within an outer surface of the bottom wall 44. As can be discerned from FIG. 8, the slots 54 are disposed at an angle relative to a plane extending through the axes of slots 54 in each of the rows.

Receptacle contacts 58 as shown in FIG. 11 include hook-shaped fork members 60, 62 extending outwardly from a base member 64. Leg sections 60*a*, 62*a* of the hook-shaped fork members 60, 62 are disposed in a lane containing the base member 64, and hook sections 60*b*, 62*b* are bent away from each other thereby defining a lead-in for a blade contact section 36. Projections 60*c*, 62*c* of hook sections 60*b*, 62*b* constitute the contact members that electrically connect with respective surfaces of the blade contact section 36 when disposed therebetween. The hook sections 60*b*, 62*b* are bent about a bend line at the juncture of the hook sections with the leg sections 60*a*, 62*a*. The relative locations of the bend lines and the projections 60*c*, 62*c* of the hook sections 60*b*, 62*b* result in both a wide lead-in at the hook sections and a minimal gap or overlapping condition at the contact points of the projections 60*c*, 62*c* with the mating blade contact section 36 to provide sufficient deflection of the fork members 60, 62 necessary to accommodate the potential range of mating tolerances. Inner surfaces of the leg sections 60*a*, 62*a* taper slightly inward from the hook sections 60*b*, 62*b* to about midway thereof and then they taper at a greater angle to the base member 64 providing a more efficient beam section optimizing its stress, force and deflection characteristics.

Base member 64 of receptacle contacts 58 has projections 64*a* extending outwardly from each side thereof and they include spaced protuberances 64*b* that frictionally engage opposing walls of slots 54 in the bottom wall 44 of the second housing 14 thereby securing the receptacle contacts 58 in slots 54 in a stable manner with the hook-shaped fork members 60, 62 being disposed within the confines of shroud 46 thereby protecting the hook-shaped fork members. The upper surfaces of projections 64*a* provide surfaces on which to push by tooling to seat the receptacle contacts 58 in the housing slots 54. A projection 64*c* extends outwardly from a bottom surface of base member 64 and it has an arcuate recess 64*d* therein. This arrangement permits solder balls 66 to be disposed in the square recesses 56 and within arcuate recesses 64*d* and soldered to projections 64*c* in accordance with conventional reflow solder practices.

As can be discerned, receptacle contacts 58 form horizontal rows and vertical columns in second housing 42 as a receptacle connector with the receptacle contacts in each row being disposed at an angle relative to a plane extending through the axes of the receptacle contacts. The receptacle connector is soldered via solder balls 64 onto conductive pads of a mother or processor circuit board.

After the blade contacts 34 are secured in first housing 16 and the receptacle contacts 58 have been secured in the second housing 42 forming first electrical connector 12 and second electrical connector 14, and they have been soldered to respective processor and mother circuit boards, the connectors are mated together as shown in FIG. 2, whereby the plug connector 12 is moved into the receptacle connector 14 with the projections 50, 52 guiding the connectors and being disposed in recesses 26, 28 and projection 48 being disposed in slot 22. This arrangement ensures that the connectors are properly mated in a polarized manner and that the blade contacts are properly electrically connected with the receptacle contacts.

As the connectors are moved toward one another, the blade sections 36 are led into the lead-ins provided by bent away hook sections 60*b*, 62*b* of the receptacle contacts 58 and then electrically engaged by the contact members 60*c*, 62*c* in a wiping action as the blade contacts 34 are electrically connected with the receptacle contacts 58. The action of the hook-shaped fork members 60, 62 in conjunction with the plug contacts being disposed at an angle relative to the receptacle contacts is a cantilever and torsional movement thereby resulting in a greater deflection at the same stress level with optimum compliance than a beam in cantilever bending only. This enables the electrical connections between the blade contacts and the receptacle contacts to absorb the manufacturing and mating tolerances that are significant compared to the size of the contacts without overstressing or damaging the contacts. This also prevents stubbing between the contacts.

The present invention provides an electrical connector that includes plug and receptacle connectors having blade contacts and receptacle contacts mating at an angle relative to each other wherein the receptacle contacts have opposed hook-shaped fork members extending outwardly from a base member with leg sections disposed in a plane and hook sections bent away from each other defining a lead-in for a blade contact as well as a controlled gap at the mating tip to be electrically connected therewith without overstressing or damaging the contacts.

What is claimed is:

1. An electrical receptacle, comprising:

a base section;

two contacts, each contact having a leg section and a contacting section;

wherein each leg section extends essentially perpendicularly from said base section to a distal end and each contacting section extends from the distal end of a leg section toward the other contact;

wherein each leg section is wider near the base section than at its distal end; and whereby said contacts undergo cantilever and torsional deflection upon insertion of a mating contact between said contacting sections.

2. The electrical receptacle of claim 1, wherein the width of each leg section tapers from said base section toward its distal end.

3. The electrical receptacle of claim 2, wherein the width of each leg section tapers along substantially the entire length of said leg section.

4. The electrical receptacle of claim 3, wherein the width of each leg section has a first taper from the base section to a point about halfway between the base section and leg section distal end, and a second taper from the halfway point to the distal end.

5. The electrical receptacle of claim 4, wherein the first taper is greater than the second taper.

6. The electrical receptacle of claim 5, wherein the leg sections are disposed in a plane containing the base section.

7. The electrical receptacle of claim 6, wherein the contacting sections are bent away from each other and out of the plane of the base section to define a lead-in for a mating contact.

8. The electrical receptacle of claim 7, wherein each contacting section extends from a leg section over a distance approximately equal to one-half the length of the leg section.

9. The electrical receptacle of claim 8, wherein each contacting section further comprises a contact projection for contacting a mating contact.

10. An electrical connector system for interconnecting circuit boards, comprising:

a first electrical connector having a first dielectric housing and an array of mating contacts mounted in said first dielectric housing;

a second electrical connector having a second dielectric housing and an array of electrical receptacles for electrical connection with said mating contacts;

wherein each of said electrical receptacle comprises:

a base section;

two contacts, each contact having a leg section and a contacting section;

wherein each leg section extends essentially perpendicularly from said base section to a distal end and each contacting section extends from the distal end of a leg section toward the other contact;

wherein each leg section is wider near the base section than at its distal end; and whereby said contacts undergo cantilever and torsional deflection upon insertion of a mating contact between said contacting sections.

11. The electrical connector system of claim 10, wherein the width of each leg section tapers from said base section toward its distal end.

12. The electrical connector system of claim 11, wherein the width of each leg section tapers along substantially the entire length of said leg section.

13. The electrical connector system of claim 12, wherein the width of each leg section has a first taper from the base section to a point about halfway between the base section and leg section distal end, and a second taper from the halfway point to the distal end.

14. The electrical connector system of claim 13, wherein the first taper is greater than the second taper.

15. The electrical connector system of claim 14, wherein the leg sections are disposed in a plane containing the base section.

16. The electrical connector system of claim 15, wherein the contacting sections are bent away from each other and out of the plane of the base section to define a lead-in for a mating contact.

17. The electrical connector system of claim 16, wherein each contacting section extends from a leg section over a distance approximately equal to one-half the length of the leg section.

18. The electrical connector system of claim 17, wherein each contacting section further comprises a contact projection for contacting a mating contact.

* * * * *